US011686531B2

(12) United States Patent
Rambure

(10) Patent No.: US 11,686,531 B2
(45) Date of Patent: Jun. 27, 2023

(54) DEVICE FOR THE EXCHANGE OF HEAT BETWEEN A FIRST FLUID INTENDED TO BE VAPORIZED AND A SECOND FLUID INTENDED TO BE COOLED AND/OR CONDENSED, AND ASSOCIATED INSTALLATION AND METHOD

(71) Applicant: TECHNIP ENERGIES FRANCE, Courbevoie (FR)

(72) Inventor: Nicolas Rambure, Herblay (FR)

(73) Assignee: Technip Energies France, Nanterre (FR)

( * ) Notice: Subject to any disclaimer, the term of this patent is extended or adjusted under 35 U.S.C. 154(b) by 0 days.

(21) Appl. No.: 15/769,190

(22) PCT Filed: Oct. 20, 2016

(86) PCT No.: PCT/EP2016/075283
§ 371 (c)(1),
(2) Date: Apr. 18, 2018

(87) PCT Pub. No.: WO2017/068072
PCT Pub. Date: Apr. 27, 2017

(65) Prior Publication Data

US 2018/0306519 A1 Oct. 25, 2018

(30) Foreign Application Priority Data

Oct. 21, 2015 (FR) ..... 1560030

(51) Int. Cl.
*F28D 7/16* (2006.01)
*F25B 39/00* (2006.01)
(Continued)

(52) U.S. Cl.
CPC ..... *F28D 7/16* (2013.01); *F25J 1/0002* (2013.01); *F25B 39/00* (2013.01); *F28D 2021/0059* (2013.01); *F28D 2021/0064* (2013.01)

(58) Field of Classification Search
CPC ..... F28D 7/16; F28D 2021/0059; F28D 2021/0064; F25B 39/00; F25J 1/0002
(Continued)

(56) References Cited

U.S. PATENT DOCUMENTS 1,617,082 A * 2/1927 Price ..... B01D 1/04 165/DIG. 175
1,617,119 A * 2/1927 Jones ..... B01D 1/04 165/DIG. 65
(Continued)

FOREIGN PATENT DOCUMENTS

CN 1409810 A 4/2003
CN 201652993 U 11/2010
(Continued)

OTHER PUBLICATIONS

PCT International Search Report dated Nov. 22, 2016 for International Application No. PCT/EP2016/075283 filed Oct. 20. 2016 (in English and French language).
(Continued)

*Primary Examiner* — Eric S Ruppert
*Assistant Examiner* — Kirstin U Oswald
(74) *Attorney, Agent, or Firm* — Locke Lord LLP; Alan B. Clement; Alicia J. Carroll

(57) ABSTRACT

The device comprises: a shell defining an interior volume to receive the first fluid extending along a longitudinal axis; a tube bundle arranged inside the shell, the tube bundle extending longitudinally in the interior volume to receive the second fluid; a disengagement member, able to perform
(Continued)

liquid vapor separation in the fluid carried from the interior volume, the disengagement member being arranged above the tube bundle. In at least one plane perpendicular to the longitudinal axis, the disengagement member includes at least two separate fluid passage regions and at least one intermediate region preventing fluid from passing.

9 Claims, 4 Drawing Sheets

(51) Int. Cl.
*F25J 1/00* (2006.01)
*F28D 21/00* (2006.01)

(58) Field of Classification Search
USPC ..... 62/516
See application file for complete search history.

(56) References Cited

U.S. PATENT DOCUMENTS 2,059,725 A * 11/1936 Carrier ..... F25B 39/02 165/110
2,344,898 A 3/1944 Rathbun
2,545,371 A * 3/1951 Mojonnier ..... F28D 1/06 165/169
2,739,575 A * 3/1956 Byerley ..... B01D 1/16 122/34
2,880,146 A * 3/1959 West ..... B01D 1/02 202/195
3,096,630 A * 7/1963 Weller ..... F25B 1/005 62/506
3,240,265 A * 3/1966 Weller ..... F25B 39/02 62/394
3,306,063 A * 2/1967 Weller ..... F25B 39/02 62/122
3,324,634 A 6/1967 Brahler et al.
3,365,900 A * 1/1968 Clark ..... F25B 1/00 62/504
3,412,569 A * 11/1968 Arledge, Jr. ..... F25B 39/02 62/504
3,472,209 A * 10/1969 Roffler ..... B01D 45/08 122/491
3,521,605 A * 7/1970 Eckstrom ..... B01D 1/12 159/901
3,524,331 A * 8/1970 Osborne ..... F25B 1/053 228/183
3,713,278 A * 1/1973 Miller ..... F22B 37/266 55/440
3,797,552 A * 3/1974 Frank ..... B01D 3/065 159/17.4
3,804,069 A * 4/1974 Bennett ..... F22B 1/025 122/34
3,916,843 A * 11/1975 Bennett ..... F22B 1/025 165/112
4,030,985 A * 6/1977 Barba ..... B01D 1/26 202/174
4,167,437 A * 9/1979 Gilbert ..... B01D 1/00 159/17.4
4,261,298 A * 4/1981 McDonald ..... F22B 37/268 122/491
4,302,227 A * 11/1981 Miller ..... B01D 45/08 122/491
4,320,566 A * 3/1982 Boyer ..... F28F 9/0135 29/402.09
4,437,322 A * 3/1984 Ertinger ..... F28F 9/026 62/504
5,330,624 A * 7/1994 Ebert ..... F28G 9/00 196/127
5,531,266 A * 7/1996 Ragi ..... F28F 13/187 165/110
5,561,987 A * 10/1996 Hartfield ..... F28D 3/02 165/117
6,167,713 B1 * 1/2001 Hartfield ..... F25B 39/028 165/DIG. 171
6,293,112 B1 * 9/2001 Moeykens ..... F28D 3/04 62/84
6,868,695 B1 * 3/2005 Dingel ..... F28F 9/0278 62/515
8,944,152 B2 * 2/2015 Kulankara ..... F28D 7/16 165/113
9,347,715 B2 * 5/2016 Schreiber ..... F28D 21/0017
9,677,818 B2 * 6/2017 Numata ..... F28D 7/16
10,132,537 B1 * 11/2018 Stamp ..... F25B 39/028
2002/0162352 A1 * 11/2002 Ring ..... F25B 31/004 62/515
2004/0031286 A1 * 2/2004 Bodell, II ..... F04D 27/0253 62/515
2008/0149311 A1 * 6/2008 Liu ..... F25B 39/028 165/115
2008/0163637 A1 * 7/2008 Ring ..... F28F 9/0265 62/304
2011/0017432 A1 * 1/2011 Kulankara ..... F28F 9/22 62/503
2011/0226455 A1 * 9/2011 Al-Anizi ..... F28F 9/0265 165/177
2013/0061632 A1 * 3/2013 Brostow ..... F25J 1/0216 62/611
2015/0013951 A1 * 1/2015 Numata ..... F28D 7/16 165/157
2017/0153061 A1 * 6/2017 Yoshioka ..... F28D 3/04
2017/0254573 A1 * 9/2017 Numata ..... F25B 39/028

FOREIGN PATENT DOCUMENTS

DE 1517379 6/1969
DE 1517379 A1 * 6/1969 ..... B01D 3/065
JP S54159501 A 12/1979
JP H08233407 A 9/1996
JP 2002340444 A 11/2002
JP 2003517560 A 5/2003
JP 2004092991 A 3/2004
WO WO 01/44730 A1 6/2001
WO WO-0144730 A1 * 6/2001 ..... F25B 39/02
WO WO-2009089488 A1 * 7/2009 ..... F25B 39/028

OTHER PUBLICATIONS

Chinese Office Action dated April 3, 2 019 issued in Chinese Application No. 201680061436.9 and English Translation.
Chinese Office Action dated Oct. 21, 2019 issued in Chinese Application No. 201680061436.9 and English Translation.
Chinese Office Action dated Mar. 20, 2020 issued in Chinese Application No. 201680061436 9 and English Translation.
Japanese Office Action dated Aug. 25, 2020 issued in JP Application No. 2018-520538 and English translation.
Chinese Office Action and English Translation issued in corresponding CN application No. 201680061436.9,dated Apr. 3, 2019 (15 pages).
Chinese Office Action and English Translation issued in corresponding CN application No. 201680061436.9 dated Oct. 2019 (15 pages).
Chinese Office Action and English Translation issued in corresponding CN application No. 201680061436.9 dated Mar. 20, 2020 (5 pages).
Written Opinion issued in corresponding PCT application No. PCT/EP2016075283, dated Nov. 22, 2016.
Japanese office action and English Translation issued in corresponding JP application No. 2018-520538, dated Aug. 25, 2020 (8 pages).
Japanese office action and English Translation issued in corresponding JP application No. 2018-520538, dated Mar. 16, 2021(6 pages).
Australian office action issued in corresponding AU application No. 2016341267, dated Jun. 28, 2021 (3 pages).
Australian office action issued in corresponding AU application No. 2016341267, dated Jan. 11, 2022 (3 pages).

* cited by examiner

DEVICE FOR THE EXCHANGE OF HEAT BETWEEN A FIRST FLUID INTENDED TO BE VAPORIZED AND A SECOND FLUID INTENDED TO BE COOLED AND/OR CONDENSED, AND ASSOCIATED INSTALLATION AND METHOD

This application is a National Stage application of International Patent Application Number, PCT/EP2016/075283, filed on Oct. 20, 2016, which claims priority to FR 15 60030, filed Oct. 21, 2015, the entire contents of which are incorporated herein by reference.

The present invention relates to a device for the exchange of heat between a first fluid intended to be vaporized and a second fluid intended to be cooled and/or condensed, comprising:

- a shell defining an interior volume to receive the first fluid extending along a longitudinal axis;
- a tube bundle arranged inside the shell, the tube bundle extending longitudinally in the interior volume to receive the second fluid;
- a disengagement member, able to perform liquid vapor separation in the fluid carried from the interior volume, the disengagement member being arranged above the tube bundle.

The heat exchange device is for example intended to be placed in a cooling train of a liquid hydrocarbon production installation, in particular a natural gas liquefaction installation.

The liquefaction of natural gas has many advantages in terms of hydrocarbon transport and conditioning. A growing quantity of the produced natural gas is liquefied in liquefaction installations with significant capacities.

To precool the natural gas, a heat exchange device of the aforementioned type is frequently used. In this case, the first fluid is for example propane. The propane is introduced in liquid or diphasic form into the interior volume of the shell, and is vaporized, while recovering the calories extracted from the natural gas circulating in the tube bundle. The natural gas is thus precooled when it passes in the heat exchange device.

Alternatively, a device of the aforementioned type is used to cool or condense refrigerants (in place of natural gas) in refrigeration loops.

The reheating of the first fluid causes it to be partially vaporized and an entrained fluid to be generated, which is re-compressed before being re-liquefied.

The entrained fluid generally includes liquid droplets, which must be separated from the gaseous stream, before the latter is introduced into the compressor.

To that end, the heat exchange device is generally provided with a disengagement member, for example made up of an open-worked lattice, through which the entrained fluid passes to eliminate the droplets.

The disengagement member is located above the liquid propane volume, at a minimal distance therefrom, so as not to soak in the liquid propane. Furthermore, the liquid propane present around the tube undergoes considerable turbulence, due to its partial vaporization, which increases the minimum distance between the disengagement member and the tube bundle.

Given the cooling capacities necessary for liquefaction, the bulk of the heat exchange device is high. Subsequently, in a natural gas liquefaction installation, in particular with a large capacity, the liquefaction trains take up considerable space. For example, in certain units, the length of the liquefaction trains can reach several tens of meters. This is acceptable when the available footprint is large, but may be problematic in other settings, where the available footprint is smaller.

One aim of the invention is to decrease the size of the heat exchange devices in a cooled and/or liquefied fluid production installation, without harming their effectiveness and operation.

To that end, the invention relates to a device of the aforementioned type, characterized in that in at least one plane perpendicular to the longitudinal axis, the disengagement member includes at least two separate fluid passage regions and at least one intermediate region preventing fluid from passing.

According to specific embodiments of the invention, the device according to the invention comprises one or more of the following features, considered alone or according to any technically possible combinations:

- each fluid passage region is formed by an open-worked partition;
- the open-worked partition is formed by a trellis having a grating structure, an assembly of parallel strips, and/or a metal foam.
- the fluid passage regions define a downstream gas recovery space, located opposite the interior volume relative to the disengagement member;
- the or each intermediate region preventing the passage of the fluid also define(s) a downstream gas recovery space, located opposite the interior volume relative to the disengagement member;
- the fluid passage regions are spaced apart horizontally and/or vertically;
- the disengagement member comprises at least a first horizontal fluid passage region located at a first height and at least a second horizontal fluid passage region located at a second height above the first height;
- the disengagement member comprises at least a third horizontal fluid passage region located vertically at the same height as the first fluid passage region, the first fluid passage region and the third fluid passage region defining an intermediate space between them, the second fluid passage region covering the intermediate space;
- the disengagement member comprises at least a first vertical fluid passage region and at least a second vertical fluid passage region, spaced horizontally apart from the first fluid passage region;
- the disengagement member includes at least two open-worked longitudinal partitions, the first fluid passage region being defined by the first open-worked longitudinal partition and the second fluid passage region being defined by the second open-worked longitudinal partition;
- the intermediate region is located below the first fluid passage region and below the second fluid passage region;
- the disengagement member comprises an open-worked partition of revolution around a vertical axis, advantageously an open-worked cylindrical partition;
- it comprises a chimney arranged above the shell, the disengagement member being arranged in the chimney;
- in the plane perpendicular to the longitudinal axis, the tube bundle defines a horizontally elongate envelope, in particular with an oblong or pseudo-trapezoidal shape;
- it comprises an inlet for introducing the first fluid into the interior volume, the introduction inlet emerging in the bottom of the interior volume, in a lower part of the shell;

the disengagement member extends over the entire length of the shell.

The invention also relates to a hydrocarbon liquefaction installation, comprising at least one liquefaction train, the liquefaction train comprising a device as described above.

The invention also relates to a method for the exchange of heat between a first fluid intended to be vaporized and a second fluid intended to be cooled and/or condensed, comprising the following steps:

providing a device as described above, passage of the first fluid in the interior volume;

passage of the second fluid in the tubes of the tube bundle;

reheating the first fluid by heat exchange with the second fluid, and at least partial evaporation of the first fluid to form an entrained fluid comprising gas and liquid droplets;

collecting the liquid present in the entrained fluid in the disengagement member, by passage of the entrained fluid through the fluid passage regions.

The invention also relates to a device for the exchange of heat between a first fluid intended to be vaporized and a second fluid intended to be cooled and/or condensed, comprising:

a shell defining an interior volume to receive the first fluid extending along a longitudinal axis;

a tube bundle arranged inside the shell, the tube bundle extending longitudinally in the interior volume;

a disengagement member, intended to perform liquid vapor separation in a fluid carried from the interior volume, the disengagement member being arranged above the tube bundle;

characterized in that, in a plane perpendicular to the longitudinal axis, the tube bundle defines a horizontally elongate envelope, in particular with an oblong or pseudo-trapezoidal shape.

In this case, the disengagement member does not necessarily include, in at least one plane perpendicular to the longitudinal axis, at least two separate fluid passage regions and at least one intermediate region preventing fluid from passing.

It may, however, comprise one or more of the above features, considered alone or according to any technically possible combination.

The invention will be better understood upon reading the following description, provided solely as an example, and in reference to the appended drawings, in which.

In the rest of the description, the terms "upstream" and "downstream" are to be understood relative to the normal flow direction of a fluid in the heat exchange device.

Figure 1:
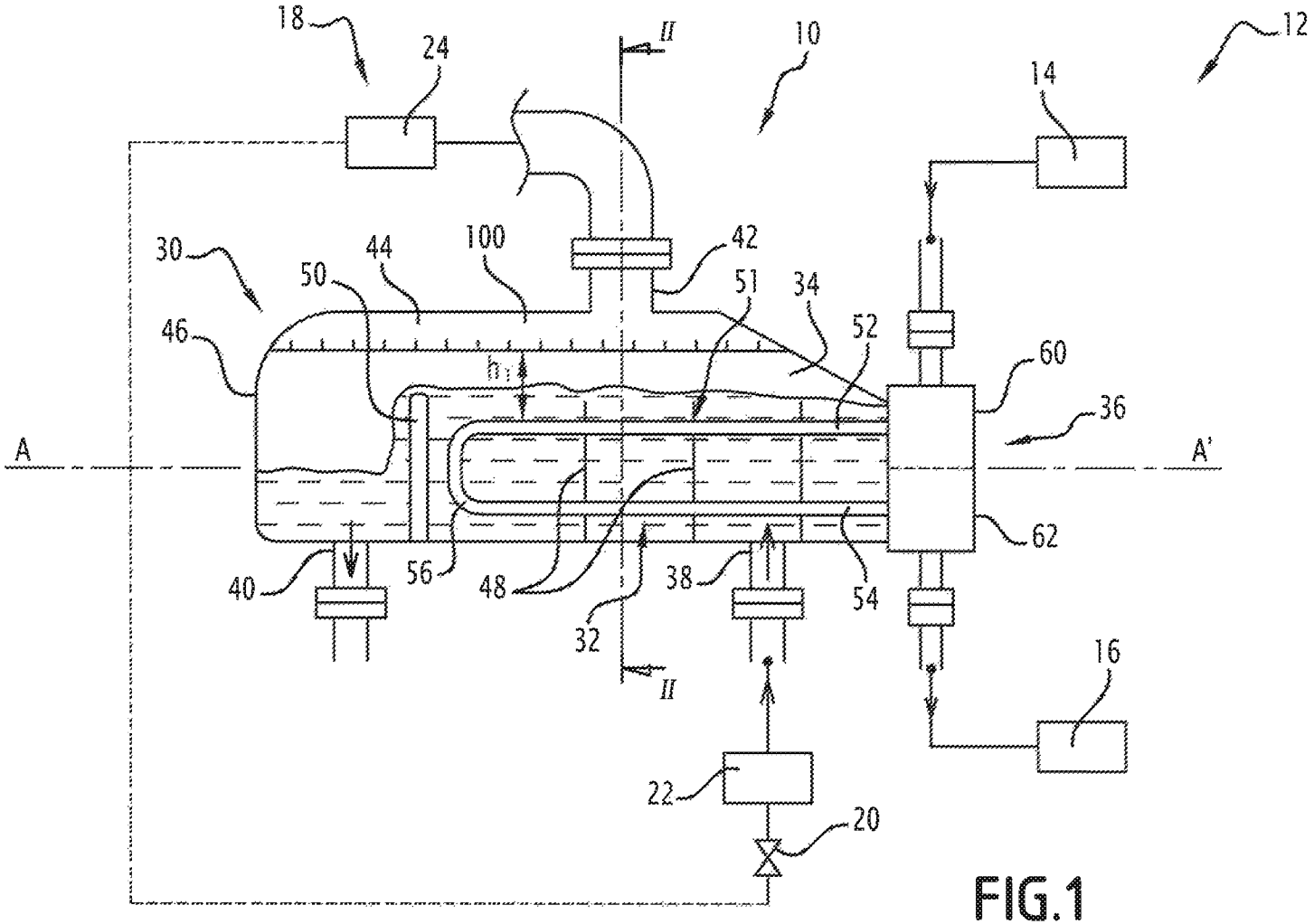
FIG. 1 is a partial sectional view along a longitudinal plane of a first heat exchange device according to the invention.

A first heat exchange device 10 according to the invention is illustrated by FIG. 1, in a fluid production installation 12, in particular a natural gas liquefaction installation.

The heat exchange device 10 is intended to create a heat exchange relationship between a first fluid circulating in a refrigeration cycle and a second fluid of the installation 12. The first fluid is able to reheat and vaporize at least partially in the device 10 to create an entrained fluid. The second fluid is able to be cooled, and advantageously liquefied in the device 10.

In this example, the first fluid is a hydrocarbon, for example propane, or a mixture of hydrocarbons.

The second fluid is advantageously natural gas or a refrigerant mixture. It is in gaseous or diphasic form upstream from the heat exchange device 10. The second fluid is in liquid or diphasic or gaseous form after it passes in the heat exchange device 10.

The installation 12 comprises a source 14 of second fluid in gaseous form, arranged upstream from the heat exchange device 10, and a capacitor 16 for collecting the second liquefied fluid, arranged downstream from the heat exchange device 10.

The installation 12 further comprises a refrigeration cycle 18, in which the first fluid circulates.

The refrigeration cycle 18 for example comprises, upstream from the device 10, an expansion member 20, such as a static expansion valve or a dynamic expansion turbine, capable of expanding the first fluid to cause it to cool, and a gas/liquid separator 22, arranged between the expansion member 20 and the heat exchange device 10. The refrigeration cycle 18 includes a compressor 24, arranged downstream from the heat exchange device 10.

In reference to FIG. 1, the heat exchange device 10 is of the type with a shell and tube bundle.

It includes an elongate shell 30, a tube bundle 32 arranged in an interior volume 34 of the shell 30 and a distributor/collector 36, able to distribute the second fluid in the tube bundle 32 and collect it at its outlet from the tube bundle 32. The tube bundle is shown schematically by a single tube in FIG. 1, The heat exchange device 10 further includes at least one lower inlet 38 for introducing the first fluid into the interior volume 34, at least one lower outlet 40 for bleeding an excess of first fluid in liquid form, and at least one upper outlet 42 for discharging the entrained gaseous stream, arranged above the shell 30.

The heat exchange device 10 also comprises a disengagement member 44, interposed between the tube bundle 32 and the upper outlet 42 in order to eliminate the liquid droplets present in the gaseous stream and entrained through the upper outlet 42.

The shell 30 extends along a longitudinal elongation axis A-A', which, in the example shown in FIG. 1, is a horizontal axis.

It has a wall 46 inwardly delimiting the interior volume 34, a plurality of baffles 48 supporting the tube bundle 32, and in this example, an inner wall 50 for retaining the first fluid around the tube bundle 32, protruding vertically in the interior volume 34, near the end of the tube bundle 32.

The tube bundle 51 for example includes more than 5000 tubes.

Each tube 51 has an inner diameter in particular comprised between 1.6 cm (⅝ inches) and 3.8 cm (1.5 inches). The tubes 51 preferably have a circular section. The tubes have no solid filling material, for example packing or catalyst.

In this example, each tube 51 has an upstream segment 52 and a downstream segment 54 extending linearly parallel to the axis A-A', and a bent intermediate segment 56 connecting the segments 52, 54. The segments 52, 54 emerge upstream and downstream in the distributor/collector 36.

Figure 2:
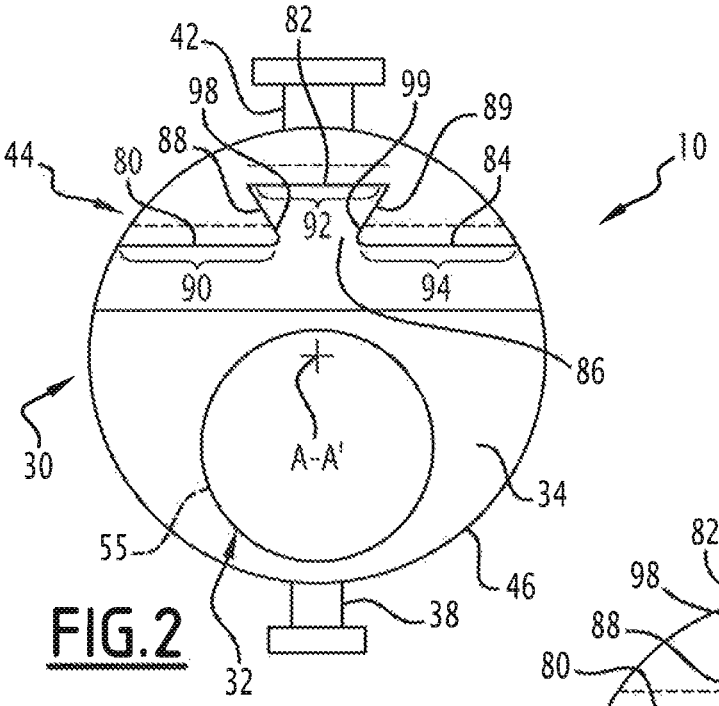
FIG. 2 is a partial sectional view along a transverse plane II-II of the device according to FIG. 1.

In the example illustrated by FIG. 2, the tubes 51 of the tube bundle 32 define, in section in a plane transverse to the axis A-A', an envelope 55 with a circular contour.

Figure 3:
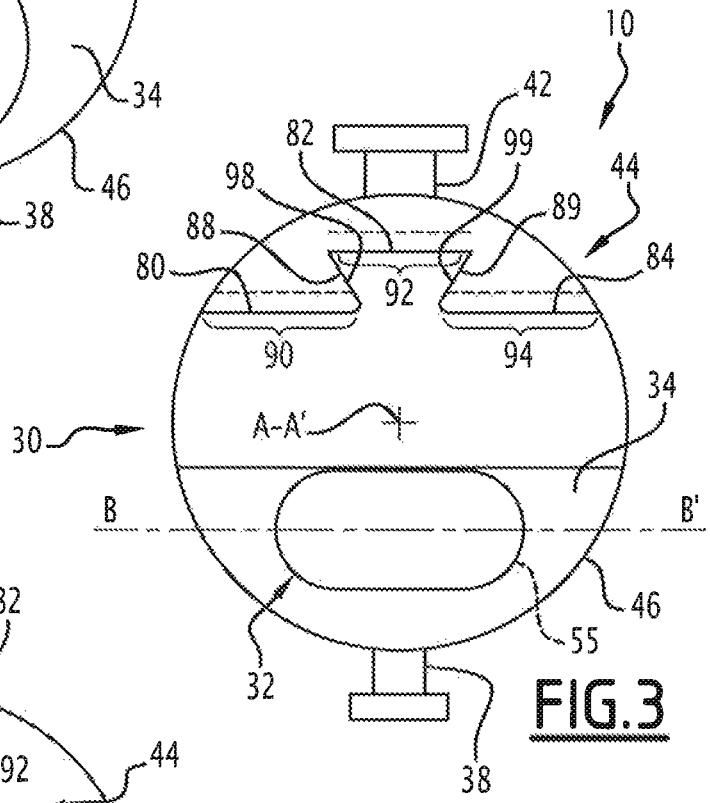
FIG. 3 is a view similar to FIG. 2 of a second heat exchange device according to the invention.
Figure 5:
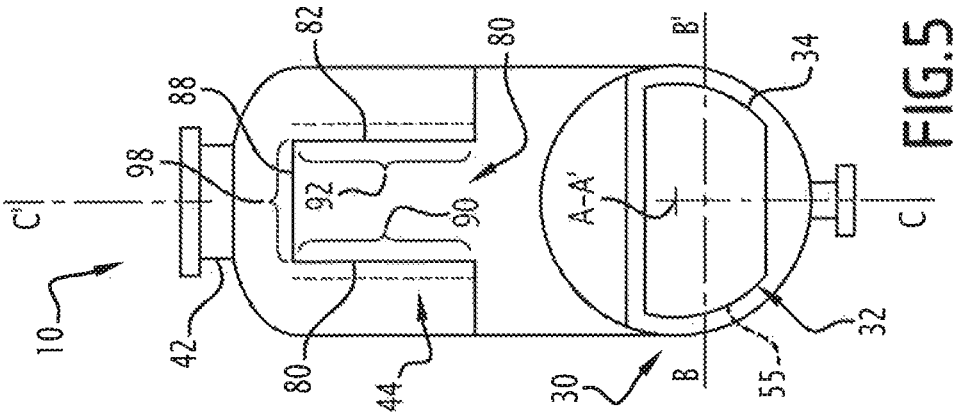
FIG. 5 is a view similar to FIG. 2 of a fourth heat exchange device according to the invention.

Alternatively, as illustrated by FIG. 3 or FIG. 5, the tubes 51 define, in section in a plane transverse to the axis A-A', an envelope 55 with an elongate contour along a horizontal axis B-B'. This envelope is for example substantially oblong with a straight edge (see FIG. 3), or pseudo-trapezoidal, with two parallel horizontal edges connected by two arc of circle-shaped contour edges (see FIG. 5).

When the envelope defined by the tubes 51 is elongate, the compactness of the heat exchange device 10 is improved, for a given height separating the tube bundle 32 from the disengagement member 44.

The distributor/collector 36 includes an upstream compartment 60 for distributing the second fluid in gaseous or diphasic form and a downstream compartment 62 for collecting the second fluid in liquid or diphasic form.

The upstream compartment 60 is connected on the one hand to the second fluid source 14, and on the other hand to the upstream segments 52 of the tubes 51.

The downstream compartment 60 is connected on the one hand to the downstream segments 54 of the tubes 51, and on the other hand to the capacitor 16 for collecting the second fluid in liquid or diphasic form.

The lower inlet 38 is vertically tapped below the shell 30, and emerges upward across from the tube bundle 32, It is able to introduce the first fluid in liquid or diphasic form by overflow in the interior volume 34. It is connected upstream to the expansion member 20, advantageously through the liquid/gas separator 22.

The retaining wall 50 has a height greater than the height of the tube bundle 32. It is able to retain the first fluid introduced through the lower inlet 38 to substantially completely submerge the tube bundle 32 in the first fluid.

The lower outlet 40 is vertically tapped below the shell 30, opposite the tube bundle 32 relative to the retaining wall 50.

The first liquid fluid not having been vaporized in the interior volume 34 is able to flow by overflow above the retaining wall 50, and to be discharged through the lower outlet 40.

The upper outlet 42 is vertically tapped above the shell 30, preferably across from the tube bundle 32, opposite the disengagement member 44 relative to the tube bundle 32. It is connected downstream to the compressor 24.

The disengagement member 44 is intended to eliminate the droplets present in the entrained fluid above the tube bundle.

It is interposed horizontally between the tube bundle 32 and the upper outlet 42, above the tube bundle 32. It advantageously extends over the entire length of the shell 30.

A minimum height h1 is maintained between the tubes 51 of the tube bundle 32 and the disengagement member 44. This height is for example greater than 600 mm.

Figure 7:
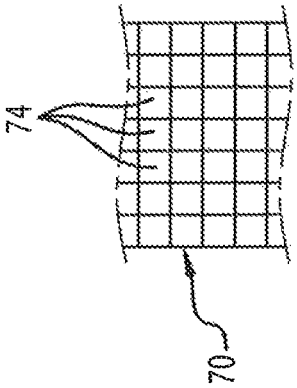
FIG. 7 is a top view of an open-worked partition in grating form for a disengagement member of a heat exchange device according to the invention.
Figure 8:
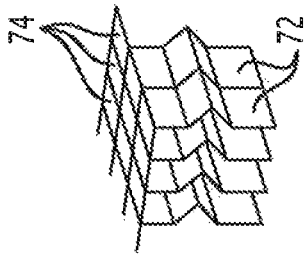
FIG. 8 is a partial perspective view of an open-worked partition in the form of adjacent strips for a disengagement member of a heat exchange device according to the invention.

The disengagement member 44 includes at least one open-worked partition formed from a lattice having a grating structure 70, as illustrated by FIG. 7, or an assembly of parallel strips 72, for example in the form of chevrons, as illustrated by FIG. 8.

The open-worked partition defines a network of cells 74, allowing the gaseous entrained fluid charged with droplets to pass, and the droplets to be collected at the periphery of the passages.

In the example shown in FIG. 2, the disengagement member 44 includes a first open-worked longitudinal partition 80 located at a first height, and a second open-worked longitudinal partition 82, arranged vertically separated from the first open-worked longitudinal partition 80 at a second height above the first height.

The disengagement member 44 further includes a third open-worked longitudinal partition 84 horizontally separated from the first partition 80, at the same height as the first partition 80.

The longitudinal partitions 80, 82, 84 are formed by open-worked plates extending horizontally over the entire length of the shell 30.

The first partition 80 and the second partition 84 define an intermediate space 86 between them upwardly covered by the second partition 82.

The width of the second partition 82 is greater than that of the intermediate space 86. Thus, at least one lateral part of the second partition 82 extends across from the first partition 80, and at least one lateral part of the second partition 82 extends across from the third partition 84.

The first partition 80 is connected to the second partition 82 by a first tilted solid wall 88. The third partition 84 is connected to the second partition 82 by a second tilted solid wall 89.

Thus, according to the invention, in each transverse plane perpendicular to the longitudinal axis A-A', the disengagement member 44 includes at least two separate fluid passage regions 90, 92, 94, and at least one intermediate region 98, 99 preventing fluid passage.

In the example illustrated in FIG. 2, at least a first fluid passage region 90 is delimited on the first open-worked partition 80, a second fluid passage region 92 is delimited on the second open-worked partition 82, and a third fluid passage region 94 is delimited on the third partition 84. The second fluid passage region 92 is located above the first fluid passage region 90 and the third fluid passage region 94 while being completely separate from these regions 90, 94.

The intermediate regions 98, 99 preventing fluid passage are respectively defined by the solid walls 88, 89.

The second fluid passage region 92 being vertically offset relative to the fluid passage regions 90, 94, it is possible to raise the disengagement member 44 in the shell 30, without decreasing the open-worked surface available for the passage of the entrained stream.

The heat exchange device 10 is therefore more compact, while retaining appropriate properties for eliminating droplets present in the entrained stream.

A heat exchange method, implemented using the device 10 according to the invention, will now be described.

In this method, the second fluid in gaseous form is brought from the source 14 to the distribution compartment 60 of the distributor/collector 36. The first fluid is distributed between the tubes 51 of the tube bundle 32 and successively circulates in the upstream segment 52, the bent intermediate segment 56, then the downstream segment 54.

During this passage in the tube bundle 32, the second fluid cools and condenses by heat exchange without contact with the first fluid located outside the tubes 51 of the bundle 32 in the interior volume 34.

The second fluid is collected in liquid form in the collection compartment 62, then is discharged outside the device 10 to the capacitor 16.

Simultaneously, first fluid in liquid or diphasic form, obtained by expansion through the expansion member 20, is introduced continuously through the lower inlet 38 in the interior volume 34, The first fluid forms a liquid bath, in which the tubes 51 of the tube bundle 32 are submerged.

The calories from the second fluid, collected by the first fluid, cause the partial evaporation of the first fluid around the tube bundle 32 and the release of an entrained stream above the tube bundle 32.

The entrained stream is made up primarily of gas, but potentially includes liquid droplets upstream from the disengagement member 44.

During the passage in the disengagement member 44, the entrained stream traverses the fluid passage regions 90, 92, 94 of the open-worked partitions 80, 82, 84. The liquid droplets are retained by the structure of the partitions 80, 82, 84, such that the entrained stream is completely gaseous in the downstream recovery space 100 located opposite the tube bundle 32 relative to the disengagement member 44.

The entrained stream is next extracted through the upper outlet 42 to be brought to the compressor 24.

In the interior volume 34, the excess non-evaporated first fluid flows by overflow from the retaining wall 50 to the lower outlet 40, before being recycled.

The presence of a disengagement member 44 having separate fluid passage regions therefore improves the compactness of the heat exchange device 10, without harming the capacity to eliminate liquid droplets in the entrained stream, while maintaining a sufficient distance between the tube bundle 32 and the disengagement member 44.

Figure 4:
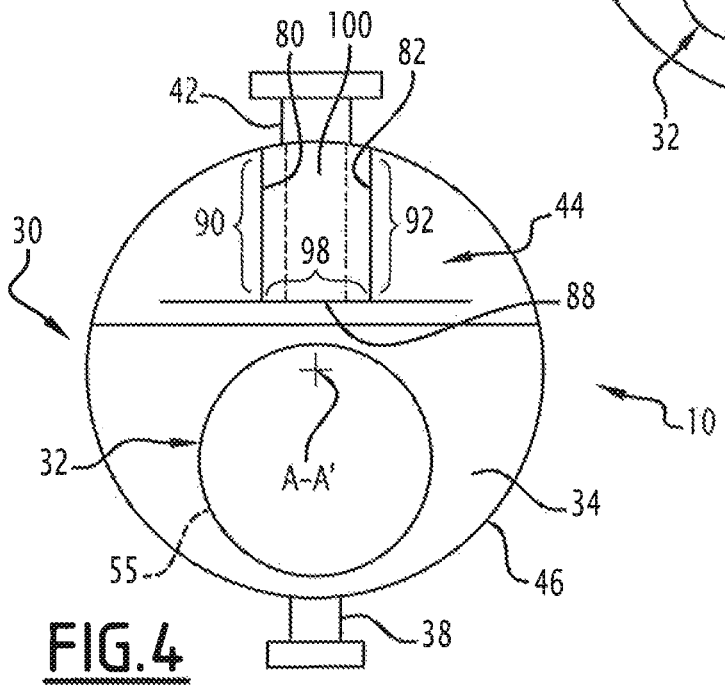
FIG. 4 is a view similar to FIG. 2 of a third heat exchange device according to the invention.

An alternative device 10 according to the invention, shown in FIG. 4, differs from the device 10 shown in FIG. 2 in that the longitudinal partitions 80, 82 extend vertically, parallel to one another over the entire length of the shell 30. The solid wall 88 extends horizontally below the partitions 80, 82 in order to close off the downstream space 100 downwardly.

The solid wall 88 protrudes laterally on either side of the walls 80, 82, to force the entrained stream to move laterally toward the outside of the shell 30, then to perform a bend to reach the open-worked partitions 80, 82.

Like before, the open-worked partitions 80, 82 respectively define, in each plane transverse to the axis A-A', a first fluid passage region 90 and a second fluid passage region 92 that are separate. The regions 90, 92 here extend vertically.

The first fluid passage region 90 and the second fluid passage region 92 are connected to one another by a horizontal solid region 98, located across from the tube bundle 32.

The operation of the device 10 shown in FIG. 4 is similar to that of the device 10 shown in FIG. 2.

Figure 6:
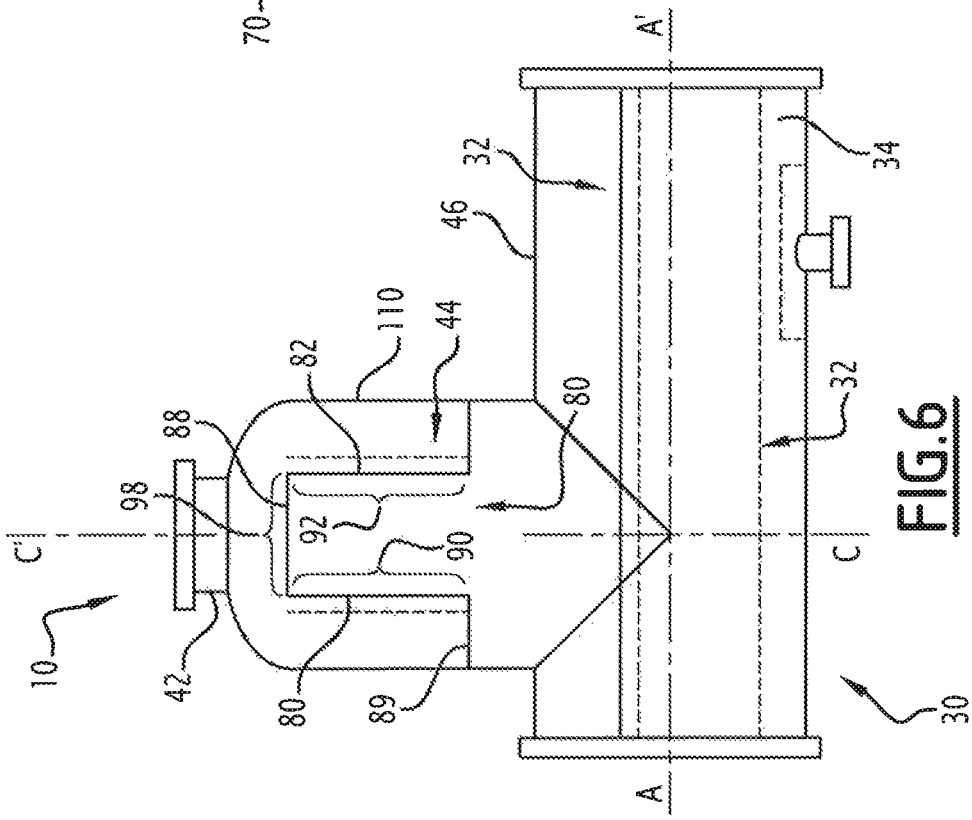
FIG. 6 is a partial sectional view along a longitudinal plane of the fourth heat exchange device.

Another alternative device 10 according to the invention is illustrated by FIGS. 5 and 6.

Unlike the device 10 shown in FIG. 1, the device 10 shown in FIGS. 5 and 6 includes a chimney 110 protruding vertically above the shell 30.

The chimney 110 is substantially cylindrical with vertical axis C-C'. It emerges in the interior volume 34, above the tube bundle 32.

The upper outlet 42 is arranged at the free end of the chimney 110.

The disengagement member 44 is contained in the chimney 110.

In this example, the disengagement member 44 includes a cylindrical open-worked partition 80 with a vertical axis, preferably coaxial with the chimney 110. It includes a solid wall 88 closing the open-worked partition 80 upwardly, and an annular solid wall 89 connecting a lower edge of the open-worked partition 80 to the periphery of the chimney 110.

The cylindrical open-worked partition 80 emerges downward across from the tube bundle 32, inside the annular solid wall 89.

Like before, in at least one transverse plane perpendicular to the axis A-A', shown in FIG. 5, the open-worked partition 80 defines a first fluid passage region 90 and a second fluid passage region 92 that are separate. The regions 90, 92 here are vertical.

The intermediate wall 88 defines a solid intermediate region 98 connecting the regions 90, 92.

Furthermore, the tube bundle 32 defines a horizontally elongate envelope, here pseudo-trapezoidal.

Figure 9:
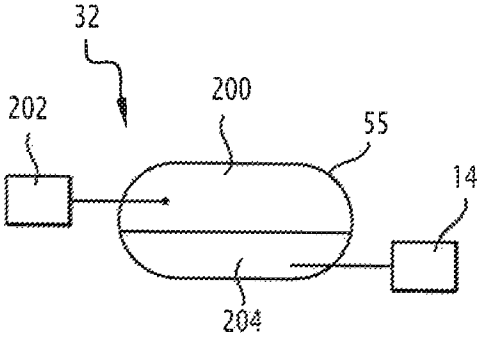
FIGS. 9 and 10 are sectional views along a transverse plane of multi-current tube bundles.

In one alternative (not shown) of the device 10 of FIG. 3, the disengagement member 44 comprises a single open-worked longitudinal partition 80 extending horizontally. The disengagement member 44 does not include, in at least one plane perpendicular to the longitudinal axis A-A', at least two separate fluid passage regions and at least one intermediate region preventing fluid from passing, In one alternative, illustrated by FIG. 9, the tube bundle 32 is a multi-current tube bundle. The tubes 51 of a first region 200 of the bundle 32 are connected to a refrigerant mixture source 202. The tubes 51 of a second region 204 are connected to the natural gas source 14.

In this example, the regions 200, 204 are located above one another.

Figure 10:
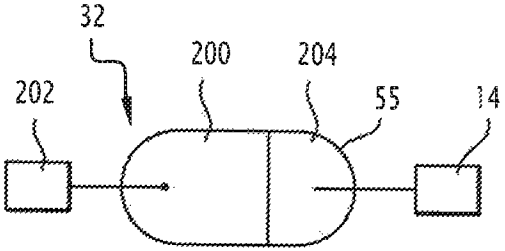

In an alternative shown in FIG. 10, the regions 200, 204 are located side by side.

Figure 11:
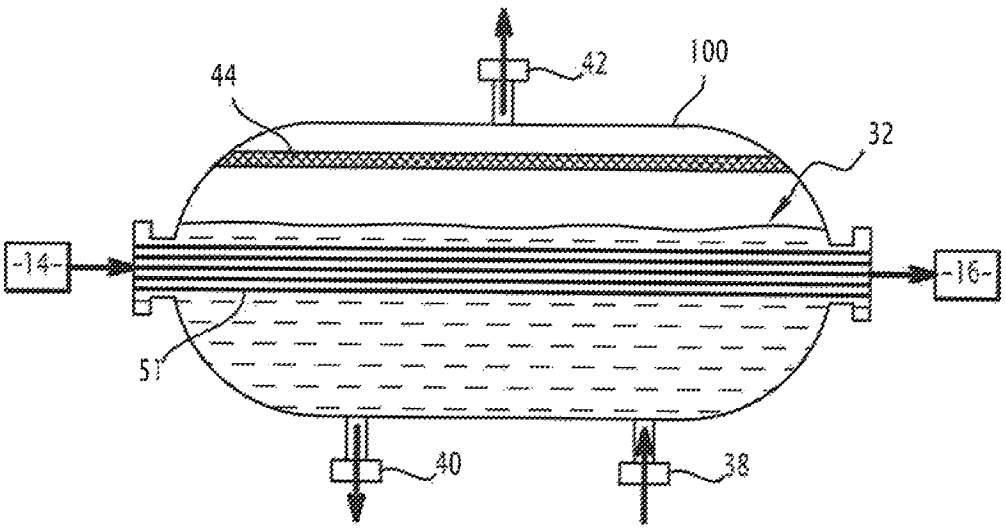
FIG. 11 is a view of the heat exchanger of a fifth heat exchange device according to the invention.

In the fifth device 10 according to the invention, illustrated in FIG. 11, the tubes 51 are straight tubes that traverse the shell 30 parallel to its axis A-A'.

In one alternative, the open-worked partition is made from a metal foam.

In another alternative, the open-worked partition includes a wall defining openings and a metal foam positioned on the openings of the wall.

The metal foam is for example an aluminum foam such as the Duocel® foam marketed by the company ERG Aerospace Corporation.

Furthermore, as clearly visible in the figures, the downstream gas recovery space 100, located opposite the interior volume relative to the disengagement member 44, is defined on the one hand by the fluid passage regions, and on the other hand by the or each region preventing the passage of fluid.

As indicated above, this downstream space 100 contains an exclusively gaseous fluid having traversed the fluid passage regions.

The invention claimed is:

1. A device for the exchange of heat between a first fluid intended to be vaporized and a second fluid intended to be at least one of cooled or condensed, comprising:

a shell defining an interior volume to receive the first fluid extending along a longitudinal axis;

a tube bundle arranged inside the shell, the tube bundle extending longitudinally in the interior volume to receive the second fluid;

a disengagement member, able to perform liquid vapor separation in the fluid carried from the interior volume, the disengagement member being arranged above the tube bundle, the disengagement member being arranged inside the interior volume defined by said shell;

wherein, in at least one same plane perpendicular to the longitudinal axis, the disengagement member includes at least a first horizontal fluid passage region of the fluid carried from the interior volume, a separate second horizontal fluid passage region of the fluid carried from the interior volume, and at least one intermediate region preventing fluid carried from the interior volume from passing, the first horizontal fluid passage region, the second horizontal fluid passage region and the intermediate region being located in said same plane perpendicular to the longitudinal axis, wherein the first horizontal fluid passage region is defined by a first horizontal open-worked partition wall and the second horizontal fluid passage region is defined by a second horizontal open-worked partition wall, each of said first horizontal open-worked partition wall and said second horizontal open-worked partition wall extending horizontally in said same plane perpendicular to the longitudinal axis, wherein, each of said first horizontal open-worked partition wall and said second horizontal open-worked partition wall includes plurality of through-openings, and wherein in said same plane horizontal to the longitudinal axis, the first horizontal open-worked partition wall is located at a first height and the second horizontal open-worked partition wall is located at a second height above the first height.

2. The device according to claim 1, wherein the fluid passage regions are spaced apart at least one of horizontally or vertically.

3. The device according to claim 1, wherein the disengagement member comprises at least a third horizontal fluid passage region located vertically at the same height as the first fluid passage region, the first fluid passage region and the third fluid passage region defining an intermediate space between them, the second fluid passage region covering the intermediate space.

4. The device according to claim 1, wherein, in the plane perpendicular to the longitudinal axis, the tube bundle defines a horizontally elongate envelope.

5. The device according to claim 1, comprising an inlet for introducing the first fluid into the interior volume, the introduction inlet emerging in the bottom of the interior volume, in a lower part of the shell.

6. A hydrocarbon liquefaction installation, comprising at least one liquefaction train, the liquefaction train comprising a device according to claim 1.

7. The device according to claim 1, wherein in said same plane perpendicular to the longitudinal axis, the first horizontal open-worked partition wall defining the first horizontal fluid passage region and the second open-worked partition wall defining the second horizontal fluid passage region are partly vertically superposed, an horizontal part of the first horizontal open-worked partition wall and an horizontal part of the second horizontal open-worked partition wall facing each other vertically, the at least one intermediate region comprising a solid wall, said solid wall connecting the first horizontal open-worked partition wall to the second horizontal open-worked partition wall.

8. The device according to claim 7, wherein said solid wall is a tilted solid wall.

9. A device for the exchange of heat between a first fluid intended to be vaporized and a second fluid intended to be at least one of cooled or condensed, comprising:

a shell defining an interior volume to receive the first fluid extending along a longitudinal axis;

a tube bundle arranged inside the shell, the tube bundle extending longitudinally in the interior volume to receive the second fluid;

a disengagement member, able to perform liquid vapor separation in the fluid carried from the interior volume, the disengagement member being arranged above the tube bundle, the disengagement member being arranged inside the interior volume defined by said shell;

wherein, in at least one same plane perpendicular to the longitudinal axis, the disengagement member includes at least a first horizontal fluid passage region of the fluid carried from the interior volume, a second horizontal fluid passage region of the fluid carried from the interior volume and a third horizontal fluid region of the fluid carried from the interior volume which are separate, the disengagement member further comprising at least a first intermediate region preventing fluid carried from the interior volume from passing and a second intermediate region preventing fluid carried from the interior volume from passing, wherein the first horizontal fluid passage region is defined by a first horizontal open-worked partition wall, the second horizontal fluid passage region is defined by a second horizontal open-worked partition wall, and the third horizontal fluid passage region is defined by a third horizontal open-worked partition wall, the first horizontal open-worked partition wall, the second open-worked partition wall and the third open-worked partition wall each extending horizontally in said same plane perpendicular to the longitudinal axis, wherein, each of said first horizontal open-worked partition wall, second horizontal open-worked partition wall and third horizontal open-worked partition wall includes a plurality of through-openings, wherein the first intermediate region is formed by a first tilted solid wall connecting the first horizontal open-worked partition wall and the second horizontal open-worked partition wall and the second intermediate region is formed by a second tilted solid wall connecting the second horizontal open-worked partition wall and the third horizontal open-worked partition wall, wherein, in said same plane perpendicular to the longitudinal axis, the first horizontal open-worked partition wall and the third horizontal open-worked partition wall are located at a first height and the second open-worked partition wall is located at a second height above the first height, wherein, in said same plane perpendicular to the longitudinal axis, the first horizontal open-worked partition wall and the third open-worked partition wall region define an intermediate space between them, the second horizontal open-worked partition wall covering the intermediate space, and wherein, in said same plane perpendicular to the longitudinal axis, a width of the second horizontal open-worked partition wall is greater than a width of the intermediate space.

* * * * *